US010586501B2

(12) United States Patent
Tsuei et al.

(10) Patent No.: US 10,586,501 B2
(45) Date of Patent: Mar. 10, 2020

(54) LOW COLOR SHIFT DISPLAY PANEL

(71) Applicant: InnoLux Corporation, Miao-Li County (TW)

(72) Inventors: Bo-Chin Tsuei, Miao-Li County (TW); Yao-Lien Hsieh, Miao-Li County (TW)

(73) Assignee: INNOLUX CORPORATION, Miao-Li County (TW)

( * ) Notice: Subject to any disclaimer, the term of this patent is extended or adjusted under 35 U.S.C. 154(b) by 0 days.

(21) Appl. No.: 16/426,758

(22) Filed: May 30, 2019

(65) Prior Publication Data

US 2019/0279582 A1 Sep. 12, 2019

Related U.S. Application Data

(62) Division of application No. 14/799,831, filed on Jul. 15, 2015.

(30) Foreign Application Priority Data

Aug. 18, 2014 (TW) ..... 103128262 A

(51) Int. Cl.
*G09G 3/36* (2006.01)

(52) U.S. Cl.
CPC ..... *G09G 3/3607* (2013.01); *G09G 3/3648* (2013.01); *G09G 2300/0426* (2013.01); *G09G 2300/0447* (2013.01); *G09G 2300/0814* (2013.01); *G09G 2300/0842* (2013.01); *G09G 2320/0242* (2013.01); *G09G 2320/068* (2013.01); *G09G 2320/0666* (2013.01); *G09G 2320/0673* (2013.01)

(58) Field of Classification Search
None
See application file for complete search history.

(56) References Cited

U.S. PATENT DOCUMENTS

2001/0038098 A1* 11/2001 Yamazaki ..... G09G 3/3233 257/72
2009/0091670 A1* 4/2009 Tsai ..... G09G 3/3648 349/38
2009/0231505 A1 9/2009 Wang

* cited by examiner

*Primary Examiner* — Brian M Butcher
(74) *Attorney, Agent, or Firm* — Bacon & Thomas, PLLC

(57) ABSTRACT

A low color shift display panel includes a pixel array. The pixel array includes a first sub-pixel and a second sub-pixel. Each of the first sub-pixel and second sub-pixel respectively includes a data line, a gate line, a first transistor coupled to the data line and a first liquid crystal capacitor, a second transistor coupled to the data line and a second liquid crystal capacitor, and a third transistor coupled to a common voltage and the second transistor. The first sub-pixel has a first ratio which is the width-to-length ratio of the third transistor divided by the width-to-length ratio of the second transistor. The second sub-pixel has a second ratio which is the width-to-length ratio of the third transistor divided by the width-to-length ratio of the second transistor. The second ratio is smaller than the first ratio.

3 Claims, 4 Drawing Sheets

LOW COLOR SHIFT DISPLAY PANEL

BACKGROUND OF THE INVENTION

1. Field of the Invention

The present invention relates to a display panel and, more particularly, to a low color shift display panel.

2. Description of Related Art

Generally, the side view of the display image may have the phenomenon of color difference and color shift, which is resulted from different optical RGB retardation. In order to solve the phenomenon of color difference and color shift, each sub-pixel, such as the green sub-pixel, the blue sub-pixel, and the red sub-pixel, in the pixel array of a display panel in current design is typically provided with several transistors, and a channel design value, i.e. a width-to-length (W/L) ratio, for the transistor in each sub-pixel is identical, which would affect the color shift performance of the display panel. With reference to FIGS. 1(A) and 1(B), there are shown first and second measurement diagrams for a prior display panel including green sub-pixels, blue sub-pixels, and red sub-pixels, wherein the channel design value (W/L ratio) of the transistor in each sub-pixel is identical. As shown in the dashed box 11 of FIG. 1(A) illustrating a diagram of 64-128 gray levels vs. side view gamma, it can be seen that the green sub-pixel, the blue sub-pixel, and the red sub-pixel are in a divergence state. As shown in FIG. 1(B) illustrating a diagram of chromaticity vs. gray levels, by comparing the normal view of white color coordinate (Wx, Wy) with the side view thereof, it can be seen a significant difference in chromaticity between normal view and side view. When watching the gamma curves in side view, it is found that the red gamma curve is higher than the green gamma curve, the green gamma curve is higher than the blue curve and, when being converted into gray levels, there is a divergence in the 64-128 gray levels, resulting in an undesired yellowish effect.

Therefore, it is desirable to provide a low color shift display panel for effectively preventing color difference and color shift from affecting the image quality.

SUMMARY OF THE INVENTION

The object of the present invention is to provide a low color shift display panel, with which, when watching from one side of the panel, the same effect of being able to avoid color difference and color shift as watching from the front can be obtained.

To achieve the object, there is provided a display panel, which comprises: a pixel array including at least a first sub-pixel and a second sub-pixel. Each of the first sub-pixel and the second sub-pixel respectively includes: a data line; a gate line; a first transistor coupled between the data line and a first liquid crystal capacitor and having a gate coupled to the gate line; a second transistor coupled between the data line and a second liquid crystal capacitor and having a gate coupled to the gate line; and a third transistor coupled between a common voltage and the second transistor and having a gate coupled to the gate line, wherein the first sub-pixel has a first ratio, which is the width-to-length ratio of the third transistor divided by the width-to-length ratio of the second transistor in the first sub-pixel, wherein the second sub-pixel has a second ratio, which is the width-to-length ratio of the third transistor divided by the width-to-length ratio of the second transistor in the second sub-pixel, and wherein the second ratio is smaller than the first ratio.

Therefore, the low color shift display panel according to the present invention is capable of reducing color difference and color shift by adjusting the width-to-length ratios of the transistors, so that watching the display image in side view is as same as watching in normal view.

DETAILED DESCRIPTION OF THE PREFERRED EMBODIMENT

Figure 1A:
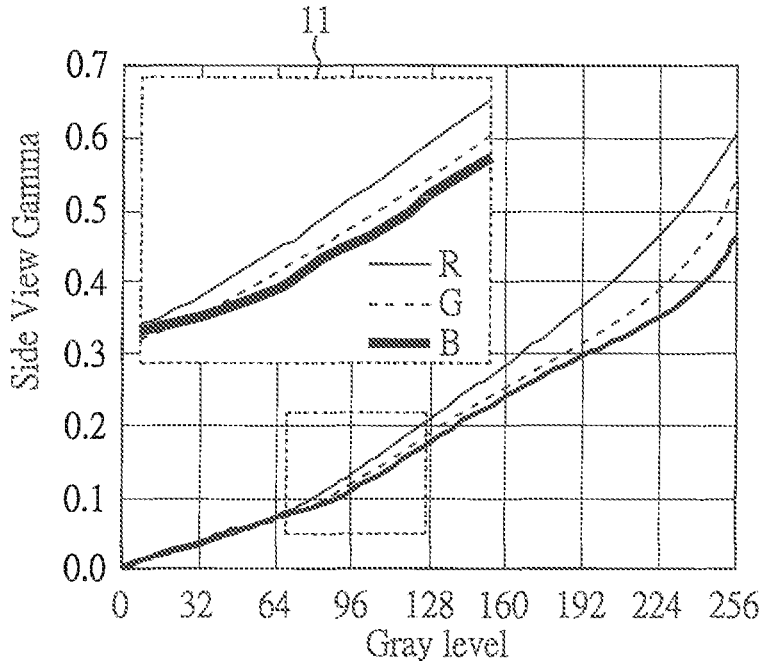
FIG. 1(A) (PRIOR ART)
FIG. 1(A) schematically illustrates a first measurement diagram of a prior display panel.
Figure 1B:
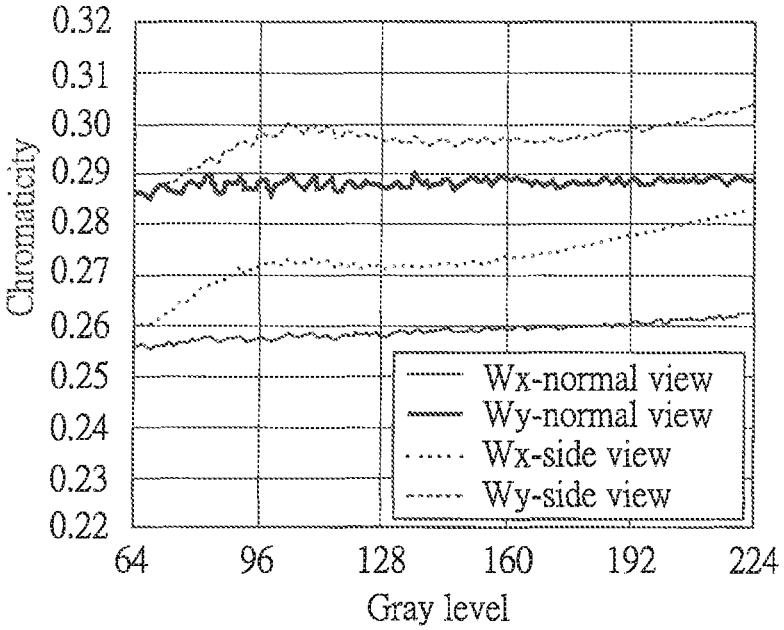
FIG. 1(B) (PRIOR ART)
FIG. 1(B) schematically illustrates a second measurement diagram of a prior display panel.
Figure 2:
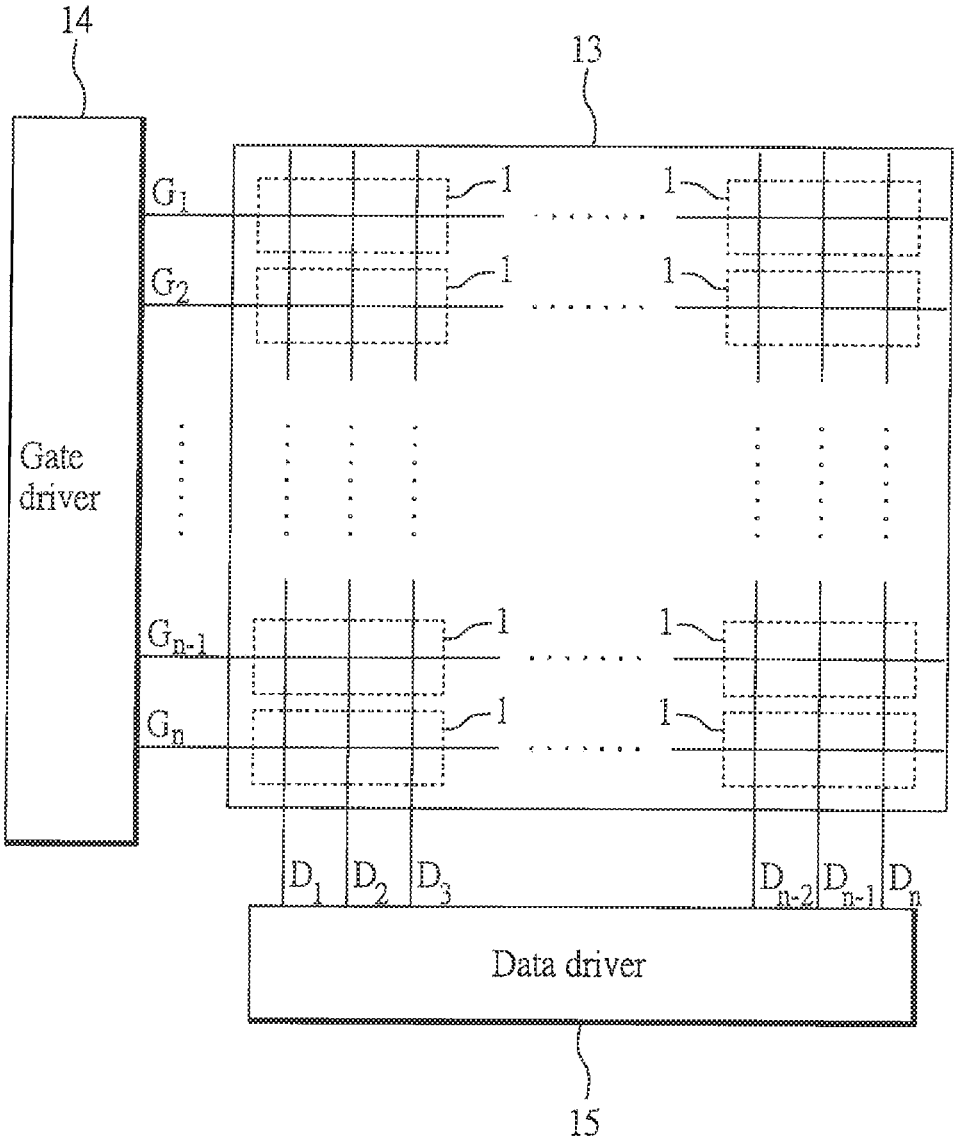
FIG. 2 is a schematic diagram of a display panel according to the present invention.
Figure 3:
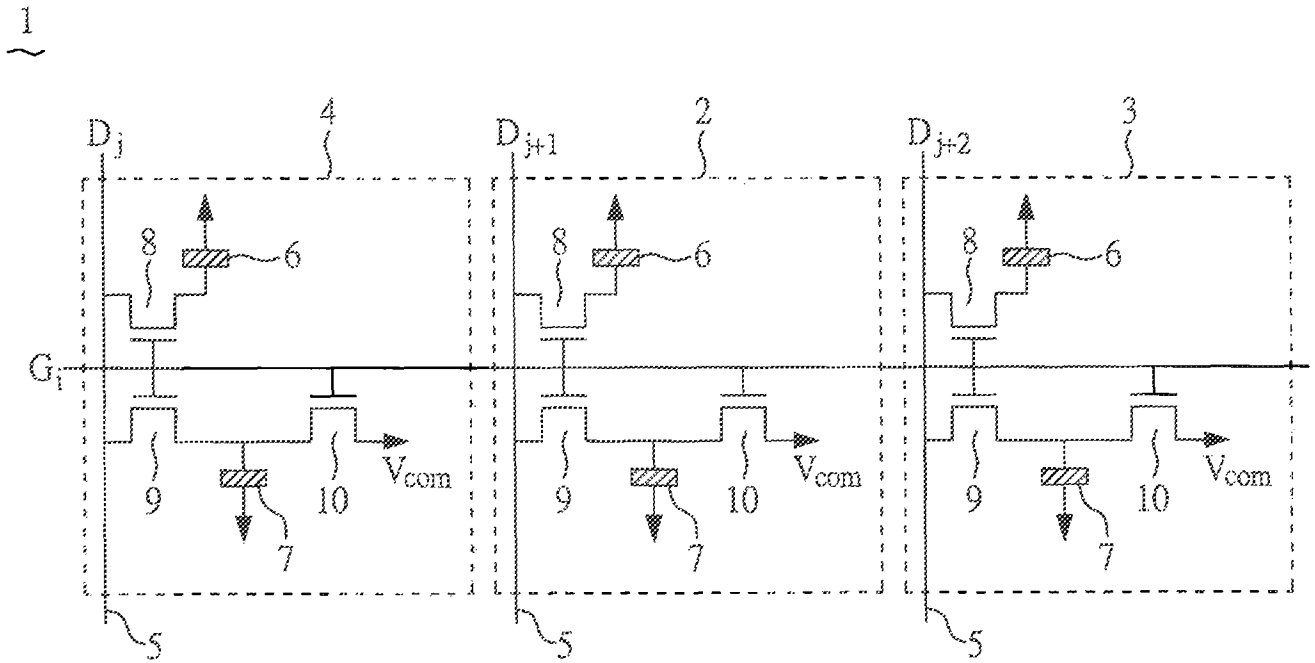
FIG. 3 is a schematic diagram of a pixel array according to the present invention.

With reference to FIGS. 2 and 3, there are shown schematic diagrams of a display panel and a pixel array according to the present invention. As shown in the figures, the display panel 13 includes: a pixel array 1; a gate driver 14 for connecting a plurality of gate lines $G_1$-$G_n$. of the pixel array 1; a data driver 15 for connecting a plurality of data lines $D_1$-$D_n$ of the pixel array 1. The pixel array 1 includes a first sub-pixel 2, a second sub-pixel 3, and a third sub-pixel 4. Each of the first sub-pixel 2, the second sub-pixel 3, and the third sub-pixel 4 includes: a data line 5; a gate line $G_i$; a first transistor 8 coupled between the data line 5 and a first liquid crystal capacitor 6 and having a gate coupled to the gate line $G_i$; a second transistor 9 coupled between the data line 5 and a second liquid crystal capacitor 7 and having a gate coupled to the gate line $G_i$; and a third transistor 10 coupled between a common voltage Vcom and the second transistor 7 and having a gate coupled to the gate line $G_i$. That is, the first sub-pixel 2 is connected to the data line $D_{j+1}$, the second sub-pixel 3 is connected to the data line $D_{j+2}$, and the third sub-pixel 4 is connected to the data line $D_j$. Preferably, in this embodiment, the first sub-pixel 2 is a green (G) sub-pixel, the second sub-pixel 3 is a blue (B) sub-pixel, and the third sub-pixel 4 is a red (R) sub-pixel, such that the first sub-pixel 2, the second sub-pixel 3, and the third sub-pixel 4 form a complete pixel of a typical liquid crystal display.

The first sub-pixel 2 has a first ratio, which is a value of the width-to-length ratio of the third transistor 10 divided by the width-to-length ratio of the second transistor 9 in the first sub-pixel 2. That is, the first ratio is (W3/L3)/(W2/L2), where W3 and L3 are the channel width and the channel length of the third transistor 10 and W2 and L2 are the channel width and the channel length of the second transistor 9 in the first sub-pixel 2. The second sub-pixel 3 has a second ratio, which is a value of the width-to-length ratio of the third transistor 10 divided by the width-to-length ratio of the second transistor 9 in the second sub-pixel 3. That is, the second ratio is (W3/L3)/(W2/L2), where W3 and L3 are the channel width and the channel length of the third transistor 10 and W2 and L2 are the channel width and the channel length of the second transistor 9 in the second sub-pixel 3.

The third sub-pixel 4 has a third ratio, which is a value of the width-to-length ratio of the third transistor 10 divided by the width-to-length ratio of the second transistor 9 in the third sub-pixel 4. That is, the third ratio is (W3/L3)/(W2/L2), where W3 and L3 are the channel width and the channel length of the third transistor 10 and W2 and L2 are the channel width and the channel length of the second transistor 9 in the third sub-pixel 4. In the low color shift display panel of the present invention, the second ratio is smaller than the first ratio and the third ratio is larger than the first ratio. By setting the first ratio, the second ratio, and the third ratio, it is able to adjust the side view performance of the display panel.

In this embodiment, the first ratio is between 0.1 and 0.5, the second ratio is larger than 0.8 times the first ratio, and the third ratio is smaller than 1.2 times the first ratio.

In another embodiment, the first ratio is between 0.2 and 0.4. Preferably, the first ratio is 0.3.

In another embodiment, the second ratio is larger than or equal to 0.9 times the first ratio. Preferably, the second ratio is 0.9 times the first ratio.

In another embodiment, the third ratio is smaller than or equal to 1.1 times the first ratio. Preferably, the third ratio is 1.1 times the first ratio.

Figure 4A:
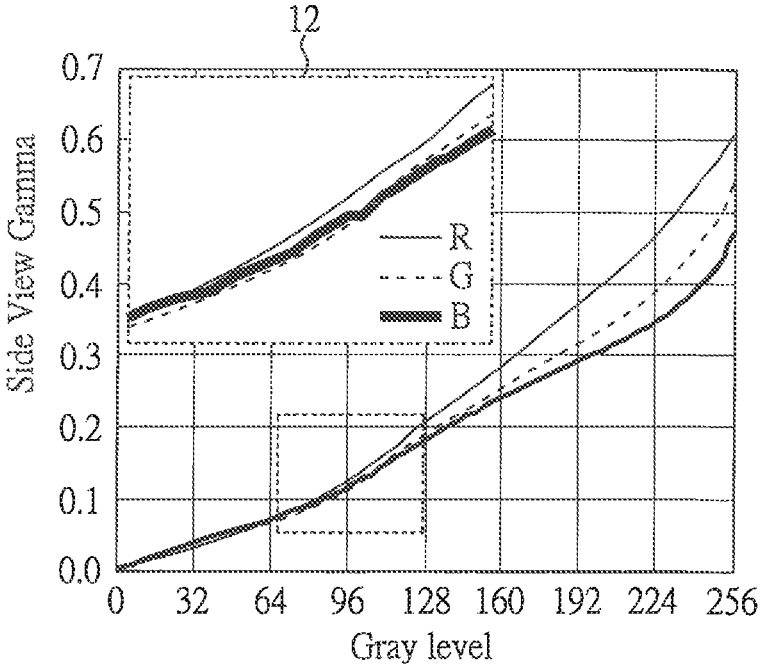
FIG. 4(A) schematically illustrates a first measurement diagram of a display panel according to the present invention.
Figure 4B:
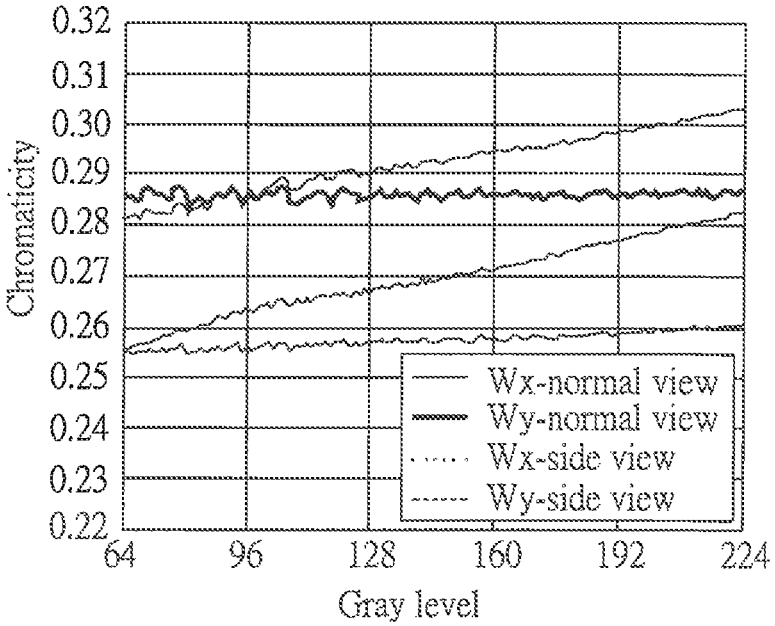
FIG. 4(B) schematically illustrates a second measurement diagram of a display panel according to the present invention.

FIGS. 4(A) and 4(B) schematically illustrate first and second measurement diagrams of a display panel, respectively, according to the present invention, wherein the second ratio is 0.9 times the first ratio and the third ratio is 1.1 times the first ratio, so that a proportion among the first ratio, the second ratio, and the third ratio is 1:0.9:1.1. As shown in a dashed box 12 of 64-128 gray-level vs. side-view gamma diagram of FIG. 4(A), it is seen that the first (G) sub-pixel 2, the second (B) sub-pixel 3, and the third (R) sub-pixel 4 are in a convergence state. As shown in the chromaticity vs. gray-level diagram of FIG. 4(B), by comparing the white color coordinate (Wx, Wy) of normal view with that of side view, it can be seen that the difference between normal view and side view is getting smaller in chromaticity, so as to reduce the effect of color difference and color shift.

With the low color shift display panel 13 of the present invention, due to that the ratio of each sub-pixel has been properly adjusted, the color difference and color shift can be avoided when watching the display panel in side view, so as to further avoid affecting the image quality and dramatically improve the display quality.

Although the present invention has been explained in relation to its preferred embodiment, it is to be understood that many other possible modifications and variations can be made without departing from the spirit and scope of the invention as hereinafter claimed.

What is claimed is:

1. A display panel, comprising:

a pixel array including at least a first sub-pixel and a second sub-pixel;

wherein each of the first sub-pixel and the second sub-pixel respectively including:

a data line;

a gate line;

a first transistor coupled between the data line and a first liquid crystal capacitor and having a gate coupled to the gate line;

a second transistor coupled between the data line and a second liquid crystal capacitor and having a gate coupled to the gate line; and a third transistor coupled between a common voltage and the second transistor and having a gate coupled to the gate line, wherein the first sub-pixel has a first ratio, which is a width-to-length ratio of the third transistor in the first sub-pixel divided by a width-to-length ratio of the second transistor in the first sub-pixel, wherein the second sub-pixel has a second ratio, which is a width-to-length ratio of the third transistor in the second sub-pixel divided by a width-to-length ratio of the second transistor in the second sub-pixel, and wherein the second ratio is smaller than the first ratio;

wherein the pixel array further includes a third sub-pixel, and the third sub-pixel includes:

a data line;

a gate line;

a first transistor coupled between the data line of the third sub-pixel and a first liquid crystal capacitor and having a gate coupled to the gate line of the third sub-pixel;

a second transistor coupled between the data line of the third sub-pixel and a second liquid crystal capacitor and having a gate coupled to the gate line of the third sub-pixel; and a third transistor coupled between a common voltage and the second transistor of the third sub-pixel and having a gate coupled to the gate line of the third sub-pixel, wherein the third sub-pixel has a third ratio, which is a width-to-length ratio of the third transistor in the third sub-pixel divided by a width-to-length ratio of the second transistor in the third sub-pixel, and wherein the third ratio is larger than the first ratio and smaller than 1.2 times the first ratio.

2. The display panel of claim 1, wherein the third ratio is smaller than 1.1times the first ratio.

3. The display panel of claim 1, wherein the third sub-pixel is a red sub-pixel.

* * * * *